US011344090B2

(12) United States Patent
Hamze

(10) Patent No.: US 11,344,090 B2
(45) Date of Patent: May 31, 2022

(54) MULTI-LAYER MULTI-COMPARTMENT COSMETIC AND PERSONAL ITEMS CONTAINER FOR HOLDING BOTH FLAT AND TALL ITEMS

(71) Applicant: Hassan Sobhi Hamze, Oakdale, NY (US)

(72) Inventor: Hassan Sobhi Hamze, Oakdale, NY (US)

( * ) Notice: Subject to any disclaimer, the term of this patent is extended or adjusted under 35 U.S.C. 154(b) by 503 days.

(21) Appl. No.: 15/136,903

(22) Filed: Apr. 23, 2016

(65) Prior Publication Data

US 2017/0303655 A1 Oct. 26, 2017

(51) Int. Cl.

| | |
|---|---|
| ***A45C 11/00*** | (2006.01) |
| ***A45D 42/00*** | (2006.01) |
| ***A45D 33/00*** | (2006.01) |
| ***A45D 40/24*** | (2006.01) |

(52) U.S. Cl.

CPC ..... *A45C 11/008* (2013.01); *A45D 33/003* (2013.01); *A45D 33/008* (2013.01); *A45D 40/24* (2013.01); *A45D 42/00* (2013.01); *A45D 2200/25* (2013.01)

(58) Field of Classification Search

CPC ..... A45C 11/008; A45C 7/0045; A45D 42/00; A45D 33/003; A45D 33/006; A45D 33/20; A45D 33/22; B65D 25/04; B65D 21/0209; B65D 21/0204; B65D 51/28; B65D 43/16; B65D 43/02

USPC ..... 220/4.26–4.27, 503, 505, 506, 512, 553

See application file for complete search history.

(56) References Cited

U.S. PATENT DOCUMENTS

| | | | | |
|---|---|---|---|---|
| 2,326,414 A * | 8/1943 | Thompson | B65D 7/00 206/503 |
| 3,144,152 A * | 8/1964 | Kopp | A47J 47/04 215/6 |
| 3,187,757 A * | 6/1965 | Jones, Jr. | A45C 11/008 132/314 |
| 3,394,861 A * | 7/1968 | Truax | B65D 25/04 220/256.1 |

(Continued)

*Primary Examiner* — Anthony D Stashick
*Assistant Examiner* — James M Van Buskirk
(74) *Attorney, Agent, or Firm* — Thomas A. O'Rourke; Bodner & O'Rourke, LLP

(57) ABSTRACT

Disclosed is a multi-compartment cosmetic and personal item container with multiple layers which are stacked on top of each other, with the ability to hold vertical tall items and horizontal flat items at the same time. Vertical tall cosmetic and personal items like lipstick, eye-shadow, eye-liner, makeup brush, perfume, nail polish, nail file, nail cutter, deodorant, lotion, etc. are contained in multiple vertical sub-compartments that form one compartment layer, with each sub-compartment holding one vertical tall item. This layer with multiple vertical sub-compartments can be stacked onto single container layers each holding one horizontal flat cosmetic or personal item like powder, rouge, foundation, sponge, cream, etc. One or more horizontal flat compartments can be stuck or screwed onto the top or the bottom of the compartment layer with plurality of vertical tall sub-compartments. Multiple horizontal flat compartments can be stuck on top of each other and onto the top and the bottom of the compartment layer with vertical tall sub-compartments using fastening mechanism at the top and bottom peripheral edges.

7 Claims, 9 Drawing Sheets

(56) References Cited

U.S. PATENT DOCUMENTS

| | | | | | |
|---|---|---|---|---|---|
| 3,442,414 | A * | 5/1969 | Pelli | A45D 33/006 | 220/324 |
| 4,239,308 | A * | 12/1980 | Bradley | A45C 11/16 | 312/201 |
| 2004/0129600 | A1* | 7/2004 | Gueret | B65D 43/162 | 206/581 |
| 2010/0200438 | A1* | 8/2010 | Davies | B65D 21/083 | 206/223 |
| 2015/0166221 | A1* | 6/2015 | Grodsky | B65D 21/0209 | 222/143 |

* cited by examiner

MULTI-LAYER MULTI-COMPARTMENT COSMETIC AND PERSONAL ITEMS CONTAINER FOR HOLDING BOTH FLAT AND TALL ITEMS

FIELD OF THE INVENTION

The present invention is in the field of multi-layer multi-compartment container that store different types of cosmetic and personal items. Particularly this invention facilitates storing multiple vertical tall items together with multiple horizontal flat items.

BACKGROUND OF THE INVENTION

Existing cosmetic and personal item containers have a number of problems. Multi-layered cosmetic and personal containers loosely store a number of items at each layer, which can freely move and in many cases can mix with each other items or can become unorganized very easily. Available multi-layered containers provide mostly flat horizontal containers, where it is difficult to store vertical tall items.

Most multi-layered containers are bulky and cannot be carried around. Multi-compartment cosmetic and personal containers that can be carried around cannot store vertical tall items or they have very limited storage for a limited number of vertical tall items. Many also do not provide the convenience of attaching, detaching, or shuffling multiple similar containers that store different items.

There is a need for a multi-compartment cosmetic and personal item container that can store both vertical and horizontal items at the same time, with the facility to store multiple vertical tall cosmetic items and multiple horizontal flat cosmetic items in a single multi-compartment container. There is also a need for a multi-compartment container that can be compact and can be conveniently carried around in purse or handbags for doing makeup and personal care on the go, with the facility to use different items held in different compartments while on the road or outside. Ability to attach, detach, or shuffling multiple similar compartments that store different items can provide added convenience, which is also needed.

BRIEF SUMMARY OF THE INVENTION

Current invention solves existing problems by providing a multi-layer multi-compartment cosmetic container that can store both vertical and horizontal cosmetic and personal items at the same time, with the facility to store multiple vertical tall items and multiple horizontal flat items in a single multi-compartment container. It is compact and can be conveniently carried around in purse or handbags for doing makeups or personal care on the go. It provides added facility to use different items held in different compartments while on the road or outside. Multiple similar compartments can be attached, detached, or shuffled to form a combined container that can serve any purpose by removing compartments that are not needed and adding compartments that are needed.

Current device solves problem with organization by containing one item each in one compartment, and by separating different items of different sizes in different layers, particularly by facilitating storage of vertical tall items all in one layer, and multiple horizontal flat items in consecutively ordered and stacked horizontal flat container layer. The device helps keep the purse clean and organized by containing different items of different shapes in one container. It also helps in reducing waste of cosmetic items as the interchangeable compartments can be removed and refilled on as needed basis, only refilling the detachable compartment that needs refilling.

The device provides a multi-layer cosmetic and personal item storage container that has multiple compartments in a vertical layer to store vertical or tall cosmetic items that have greater height than width, for example, lipstick, perfume, makeup brush, eye-liner, mascara, lipcolor, lipgloss, nail file, nail cutter, etc. A number of vertical sub-containers are attached together in a single layer compartment to facilitate storing a number of vertical cosmetic and personal items separately but conveniently together in one layer in a space-saving manner. These vertical sub-containers can be permanently constructed together with shared surface wall to provide a rigid and fixed arrangement that will not get separated even if it falls on the ground. On the other hand, these vertical sub-compartments can be constructed as separate containers with their own side walls, which can be attached with each other to form a collective container to store multiple vertical cosmetic items. These attachable and detachable vertical sub-compartments can be reshuffled to ensure only required items are contained in the combined container.

This device also provides multiple horizontal compartment layers that can be attached on the top of the vertical sub-compartment layer or at the bottom of the vertical sub-compartment layer. These horizontal compartment layers are thin and have greater width or diameter than height, and can store similar horizontal or flat cosmetic and personal items; for example, powder, foundation, cream, eye-shadow, rouge, etc. One or more than one horizontal compartments can be attached on the top, or at the bottom of the compartment layer with multiple vertical sub-compartments, facilitating storage of multiple horizontal cosmetic and personal items in separate compartments. These horizontal compartments are also easily interchangeable, replacing one with another similar one. Their numbers and combinations can be arranged in many different ways, with one or more horizontal compartments at the top can be combined with one or more horizontal compartments at the bottom. Alternatively, horizontal compartments from either the top or the bottom can be removed completely, using either compartments only at the bottom or only on the top of the vertical sub-compartments.

Horizontal layer compartments have fastening mechanism at the top peripheral edge and at the bottom peripheral edge. Layer with vertical sub-compartments also have fastening mechanisms at the top and bottom peripheral edge. One example of fastening mechanism can be screw type mechanism with helical ridge on the outer and inner peripheral edges whereby inner circular peripheral edge one layer can be screwed onto outer circular peripheral edge of another layer. Another example of the fastening mechanism can be male type depressed peripheral edge which can be stuck onto female type expanded peripheral edge. Another example could be fastening mechanism with snap on groove on the peripheral edge of one layer and ridge on the peripheral edge of another layer. Either groove or ridge can be on the outer peripheral with the other on the inner peripheral, and thus can be snapped onto each other fastening two layers of compartments.

Structure of the perimeter of the layers can be circular, elliptical, trigonal, rectangular, square, pentagon, hexagon, or any other possible geometric structure. All the layers of the same compartment would have the same geometric shape, so that each layer can be easily fastened onto other layer. Circular layers can be fastened onto other circular layer with screw type fastening mechanism. Compartments with all other possible geometric structures have to fastened using other fastening mechanisms, for example male-female snap on, groove and ridge snap on, etc. Compartments with circular geometric structures can also be fastened using these alternate fastening mechanisms. Thin containers with elliptical or rectangular peripheral walls are easier to carry in handbag, and other bags. Narrow containers with circular, square, hexagonal peripheral walls can also be carried in handbag and small bags. On the other hand, tick containers with circular, square, hexagonal geometric structures can hold enough cosmetic and personal items for any long journey, or for a whole day, or for multiple events.

Different variations of the multi-compartment design can provide additional functionalities to make the compartment even more useful.

In some embodiments, vertical sub-compartments can be covered with spaying mechanism to contain liquid that can be sprayed; for example, perfume, deodorant, etc.

In some embodiments, the layer with vertical sub-compartments can be swollen in the middle to contain more cosmetic material, and at the same time can provide easy grip to hold the compartment while using on the move.

In some embodiments, another variation of the design can include increasingly expanded layers that are attached on top or bottom of the layer with multiple vertical sub-compartments. Such expanded top and bottom with narrow middle layer with multiple vertical sub-compartments provides good grip to hold the middle part of the combined container, and at the same time expanded horizontal layers provide more space to hold horizontal cosmetic items.

In some embodiments, a design variation can have a door on the side of the vertical sub-compartments to access them directly without opening the top cover or top covering horizontal layers, which would involve unfastening the fastening mechanism. Without the door, vertical sub-compartments can be accessed only by opening the top cover or horizontal layers covering the open top.

Open top of the topmost layer, whether it is the vertical layer with multiple vertical sub-compartments or a horizontal container layer, can be covered with a cover with peripheral edge with fastening mechanism.

In some embodiments, top cover of the topmost horizontal container layer can have a mirror on the inside of the cover. This mirror can be used for looking at the face while applying cosmetic in any of the compartment of the container.

In some embodiments, top cover of the topmost horizontal container layer with a mirror on the inside of the cover can be hinged with the top peripheral edge of the container, so that the mirror can be flipped open while applying cosmetic or cosmetic from the container.

In some embodiments, there can be a mirror at the bottom part of the bottommost horizontal compartment. Additionally, the mirror can hinged with the peripheral edge of the container or the mirror can come off as a detachable part. This mirror can be used while applying cosmetic or make from any compartment of the container.

The multi-layer multi-compartment container with capacity to store both horizontal and vertical cosmetic items can be built with any suitable material that can be used to build cosmetic container, cosmetic box, or other cosmetic device. For example, it can be built with plastic, acrylic, plastic variant, metal, metal hybrid, carbon fiber, glass, wood, or a combination of any of these materials.

BRIEF DESCRIPTION OF THE DRAWINGS

The present disclosure, in accordance with one or more embodiments, is described in detail with reference to the following figures. The drawings are provided for purposes of illustration only and merely depict typical or example embodiments. These drawings are provided to facilitate the reader's understanding of the apparatus and its use and shall not be considered limiting of the breadth, scope, or applicability of the invention. It should be noted that for clarity and ease of illustration these drawings are not necessarily made to scale.

Figure 1:
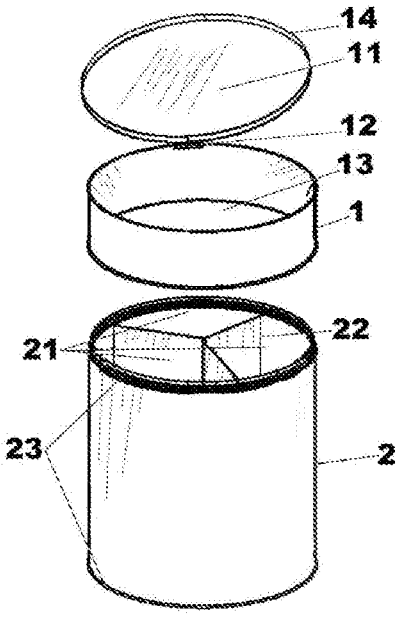
FIG. 1 is an exploded perspective view of an embodiment with a layer with three vertical sub-compartments that is covered on the top by a horizontal compartment layer, wherein all layers have circular perimeter.

The figures are not intended to be exhaustive or to limit the embodiments to the precise form disclosed. It should be understood that the various embodiment can be practiced with modification and alteration, and that the invention is limited only by the claims and the equivalents thereof.

DETAILED DESCRIPTION OF THE INVENTION

The embodiments described herein are exemplary. Descriptions in terms of these embodiments is provided to allow various features to be portrayed in the context of an exemplary application. As will be clear to one of ordinary skill in the art, the invention can be implemented in different and alternative embodiments without departing from the spirit or scope of the invention.

Unless defined otherwise, all terms used herein have the same meaning as is commonly understood by one of ordinary skill in the art to which this invention belongs.

Description

In disclosed device, multiple vertical sub-compartments are all combined together in one compartment layer 2. The sub-compartments are separated by vertical surface walls 22. A cover or a horizontal compartment layer 1 can cover the top openings 21 of plurality of sub-compartments of the vertical layer 2. Another horizontal compartment layer 3 can be attached to the bottom of the vertical layer 2. More than one horizontal compartment layers can also be attached on top of the vertical layer 2 by adding other horizontal compartment layers 1*a*, 1*b*, 1*c*, etc. in addition to one horizontal compartment layer 1. In the same way, more than one horizontal compartment layers can be attached to the bottom of the vertical layer 2 by adding other horizontal compartment layers 3*a*, 3*b*, 3*c*, etc. in addition to one horizontal compartment layer 3. Solid bottom boundary floor 13 of compartment layer 1 is a horizontal boundary floor that stretches up to the vertical boundary walls of compartment layer 1. Multiple sub-compartment layer 2, and other compartment layers 1*a*, 1*b*, 1*c*, 3*a*, 3*b*, 3*c*, etc. also have solid bottom floor like 13. Solid bottom boundary floor 13, and enjoining vertical boundary walls form an empty cavity or space with top openings, such as 21, 13*a*, 13*b*, etc.

Multiple vertical sub-compartments 2*a*, 2*b*, etc. can be attached to each other using extended embossed projection 28 and corresponding depressed surface 29 on vertical surface walls 22. Multiple horizontal compartment layers 1, 1*a*, 1*b*, etc. can be stacked on top of vertical layer 2 by attaching on top of each other. For example, 1*b* can be attached on top of 2 covering top openings 21, 1*a* can be attached on top of 1*b* covering top opening 13*b*, and 1 can be attached on top of 1*a* covering top opening 13*a*. Similarly, multiple horizontal compartment layers 2, 2*a*, 2*b*, etc. can be stacked at the bottom of vertical layer 2 by attaching on top of each other. For example, 3*b* can be attached at the bottom of 2, 3*a* can be attached at the bottom of 3*b*, and 3 can be attached at the bottom of 3*a*.

Compartment layer 2 with multiple vertical sub-compartments have fastening mechanism at the top peripheral edge 23 and the bottom peripheral edge 23 of the layer 2. Top horizontal compartment layer 1 has fastening mechanism at the bottom peripheral edge 15, which is attached to the fastening mechanism at the top peripheral edge 23 of the vertical layer 2. Bottom horizontal compartment layer 3 has fastening mechanism at the top peripheral edge 35, which is attached to the fastening mechanism at the bottom peripheral edge 23 of the vertical layer 2.

When using multiple horizontal compartment layers 1*a*, 1*b*, etc. on top of the vertical layer 2, fastening mechanism 15*a*, 15*b*, etc. at their bottom peripheral edge gets attached to the fastening mechanism at the top peripheral edge of the lower layer. When using multiple horizontal compartment layers 3*a*, 3*b*, etc. at the bottom of the vertical layer 2, fastening mechanism 35*a*, 35*b*, etc. at their top peripheral edge gets attached to the fastening mechanism at the bottom peripheral edge of the upper layer. For example, fastening mechanism at the top peripheral edge 35*b* of the horizontal compartment layer 3*b* gets attached to the fastening mechanism at the bottom peripheral edge 23 of the vertical layer 2; fastening mechanism at the top peripheral edge 35*a* of the horizontal compartment layer 3*a* gets attached to the fastening mechanism at the bottom peripheral edge 33*b* of the horizontal compartment layer 3*b*; fastening mechanism at the top peripheral edge 35 of the horizontal compartment layer 3 gets attached to the fastening mechanism at the bottom peripheral edge 33*b* of the horizontal compartment layer 3*b*.

Topmost horizontal compartment layer 1 can be covered with a cover 14. The cover 14 can be attached to the top peripheral edge of 1 with fastening mechanism. 14 can also be connected to 1 with a hinge 12, so that 14 can be flipped open to uncover the container cavity of 1. There can be a mirror 11 on the bottom inside of the cover 14 for use when applying cosmetic or toiletry item.

Bottommost horizontal compartment layer 3 can also have a mirror 31 attached to the inside of the bottom cover 34, which can be attached with fastening mechanism at the top peripheral edge of 34 and fastening mechanism at the bottom peripheral edge of 3. Bottom cover 34 along with the mirror 31 can also be connected with a hinge 32, so that the mirror 31 can be flipped open for use when applying cosmetic or toiletry item.

Figure 2:
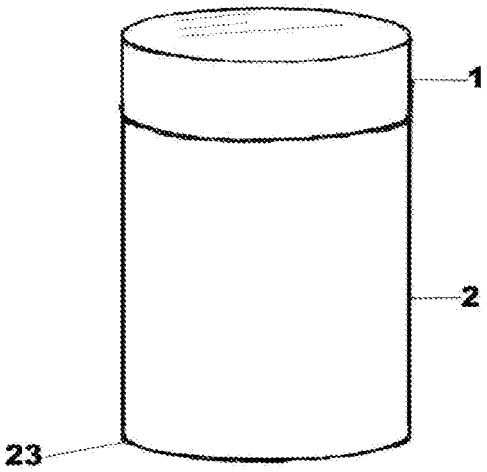
FIG. 2 is an assembled perspective view of the embodiment in FIG. 1.

FIGS. 1 and 2 show the device according to one example of the invention. The device has at least one layer with a single horizontal compartment that can be stuck onto the top or the bottom of multiple vertical sub-compartment layer 2. In this example embodiment, one layer with one horizontal compartment 1 is stuck on top of the vertical sub-compartment 2, which has multiple vertical sub-compartments with top opening 21 and with separating common boundary walls 22. In this example embodiment there are three sub-compartments, but there can be any plural number of vertical sub-compartments, with the only limitation being the number of vertical sub-compartments has to be more than one. The sub-compartments are vertical or tall with height greater than width or diameter. Vertical or tall shape enables storing vertical or tall cosmetic or toiletry items.

Figure 3:
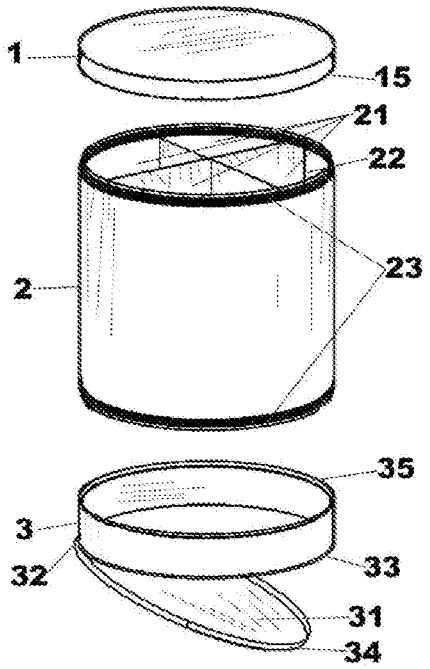
FIG. 3 is an exploded perspective view of an embodiment with a layer with four vertical sub-compartments that is covered on the top by a cover, and a horizontal compartment layer is stuck to the bottom of the vertical layer, wherein all layers have circular perimeter.
Figure 4:
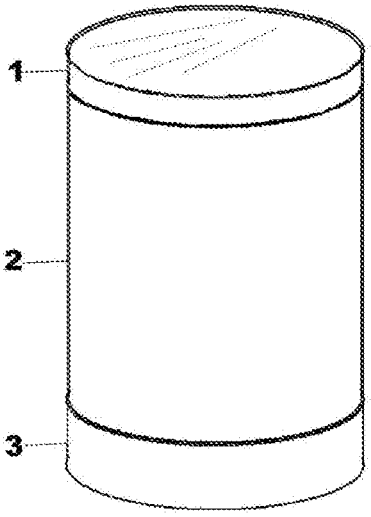
FIG. 4 is an assembled perspective view of the embodiment in FIG. 3.

FIGS. 3 and 4 show another example of the device. Similar to the example embodiment of FIGS. 1 and 2, this example embodiment has only one horizontal compartment 3, which is stuck or fastened at the bottom of the compartment layer 2 with multiple vertical sub-compartments. Since the top openings 21 of the vertical compartment layer 2 is not covered by a horizontal compartment layer, a cover 1 is used to cover the top openings 21. Outside peripheral edges 23 at the top and the bottom of 2 have screw like helical ridges. Bottom inside peripheral edge 15 of top cover 1 and top inside peripheral edge 35 of the bottom horizontal compartment layer have similar screw like helical ridges. Since all these layers are circular in shape in this example embodiment, they can be attached and fastened together like screws using the complimenting helical ridges.

Figure 5:
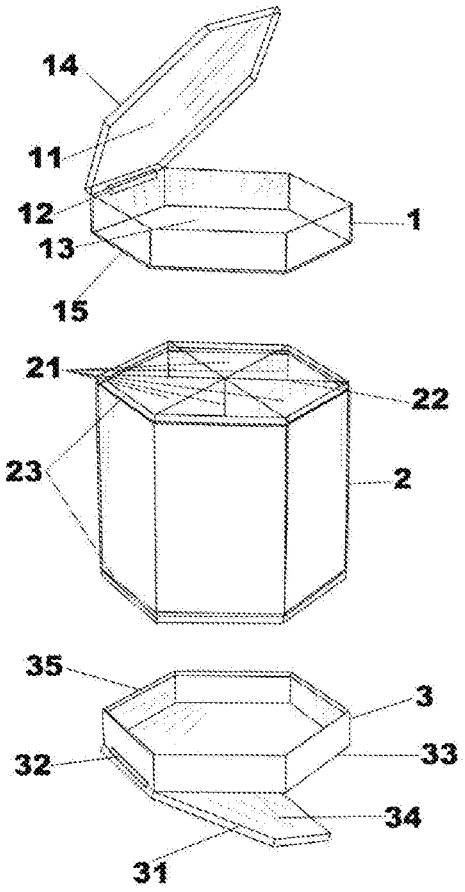
FIG. 5 is an exploded perspective view of an embodiment with a layer with six vertical sub-compartments that is covered on the top by a horizontal compartment layer, and another horizontal compartment layer is stuck at the bottom of the vertical layer, wherein all layers have hexagonal perimeter.
Figure 6:
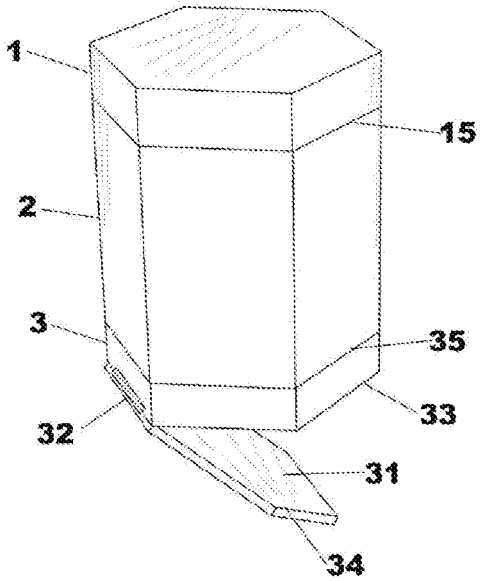
FIG. 6 is an assembled perspective view of the embodiment in FIG. 5.

FIGS. 5 and 6 show an example of the device with hexagonal perimeter shape. It has six triangle shaped vertical sub-compartments at the vertical layer compartment 2. Two horizontal layers 1 and 3 with one horizontal compartment each are attached onto the top and the bottom of 2. Since all these layers have hexagonal perimeter, they cannot be attached with each other using screw like fastening mechanism. Therefore, male type depressed peripheral edge 23 is used as fastening mechanism at the top and the bottom peripheral edge of 2. Bottom peripheral edge 15 of the top horizontal compartment layer 1 and top peripheral edge 35 of the bottom horizontal compartment layer 3 have female type expanded peripheral edge, which can be stuck on top of male type depressed peripheral edge 21.

FIGS. 9, 12, 18, and 21 show how vertical sub-compartment of some embodiments can be attached to each other and detached from each other. For example, two vertical sub-compartments 2*a* and 2*b* can be attached to each other using extended embossed projection 28 and corresponding depressed surface 29 on vertical surface walls 22. This makes vertical sub-compartments 2*a* and 2*b* interchangeable with any similar vertical sub-compartments. They can be replaced when the cosmetic contained in them runs out, with a similar one that has already been filled up.

Figure 7:
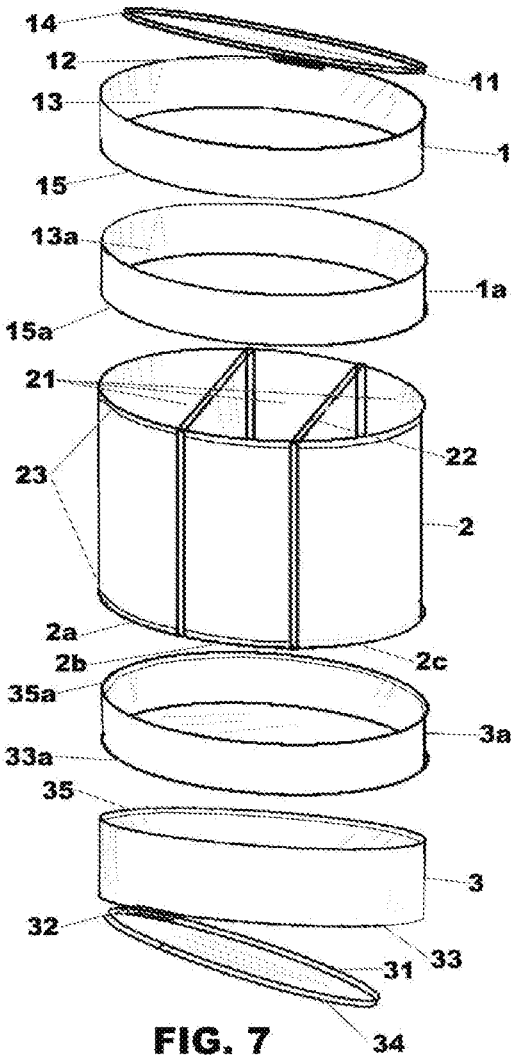
FIG. 7 is an exploded perspective view of an embodiment with a layer with three vertical sub-compartments that is covered on the top by two consecutive horizontal compartment layers stuck on top of each other, and two other consecutive horizontal compartment layers that that are stuck on top of each other are stuck at the bottom of the vertical layer, wherein all layers have elliptical perimeter.
Figure 8:
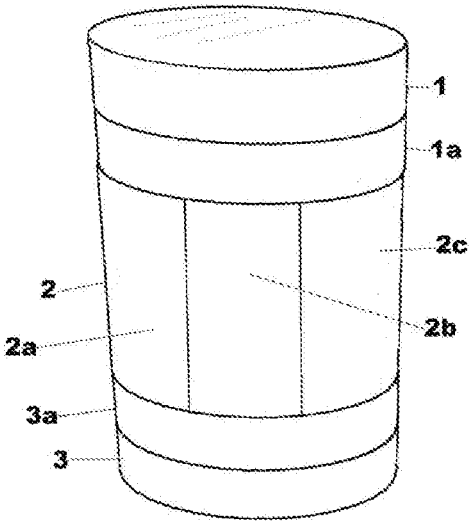
FIG. 8 is an assembled perspective view of the embodiment in FIG. 7.
Figure 9:
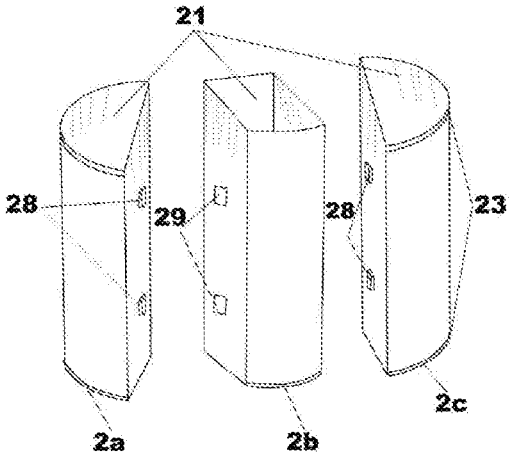
FIG. 9 is an exploded perspective view of the three vertical sub-compartments of the middle layer of the embodiment in FIGS. 7 and 8.

FIGS. 7, 8 and 9 show one example embodiment with elliptical shape, with two top horizontal compartment layers 1 and 1*a*, and two bottom horizontal compartment layers 3 and 3*a*. 1 and 3 both have top cover 14 and 34 with mirrors 11 and 31. 1 and 3 are interchangeable, and can also be exchanged with another similar elliptical horizontal compartment layer with cover. This helps shuffling a number of horizontal layer compartments containing multiple vertical cosmetic item, using only the ones that are needed or useful.

Figure 10:
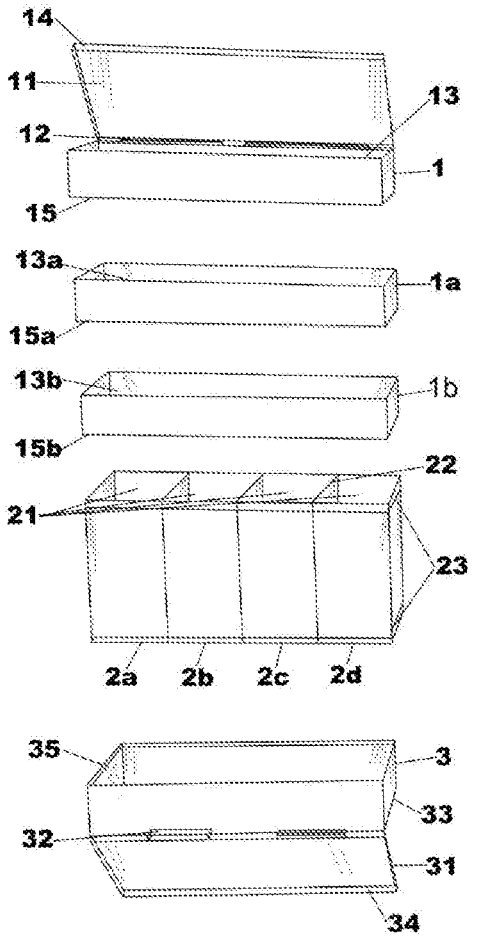
FIG. 10 is an exploded perspective view of an embodiment with a layer with four vertical sub-compartments that is covered on the top by three consecutive horizontal compartment layers stuck on top of each other, and another horizontal compartment layer is stuck at the bottom of the vertical layer, wherein all layers have long rectangular perimeter.
Figure 11:
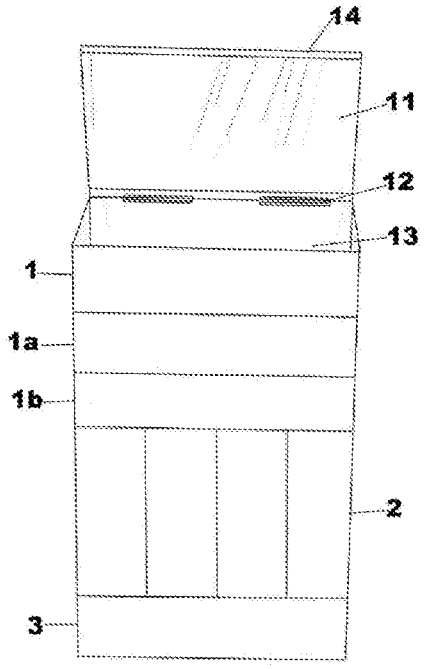
FIG. 11 is an assembled perspective view of the embodiment in FIG. 10.
Figure 12:
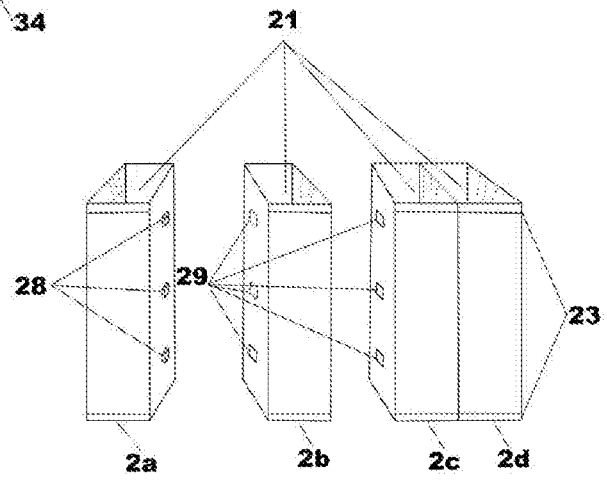
FIG. 12 is an exploded perspective view of the four vertical sub-compartments of the middle layer of the embodiment in FIGS. 10 and 11.

FIGS. 10, 11, and 12 show one example embodiment with rectangular shape, with a number of horizontal compartment layers 1*a*, 1*b*, 1, and 3. 1*a* and 1*b* are interchangeable and can also be interchanged with similar attachable and detachable layers with horizontal compartments. Rectangular shape makes the combined container thin and easy to carry in a purse or handbag. Rectangular shape also makes the shape of all the vertical sub-compartments that same, and therefore making these attachable and detachable sub-compartments easy to interchange or shuffle.

Figure 13:
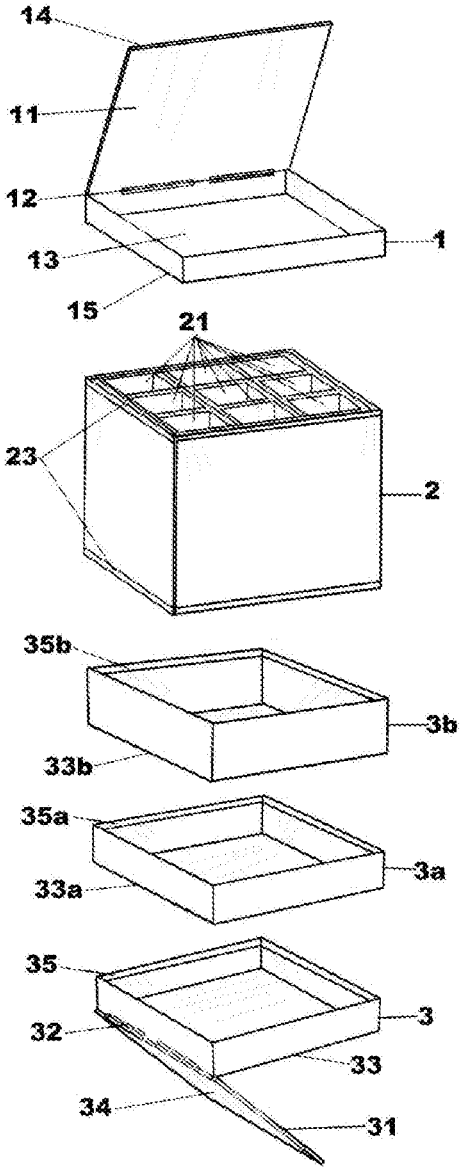
FIG. 13 is an exploded perspective view of an embodiment with a layer with nine vertical sub-compartments that is covered on the top by a horizontal compartment layer, and three other consecutive horizontal compartment layers that that are stuck on top of each other are stuck at the bottom of the vertical layer, wherein all layers have square perimeter.
Figure 14:
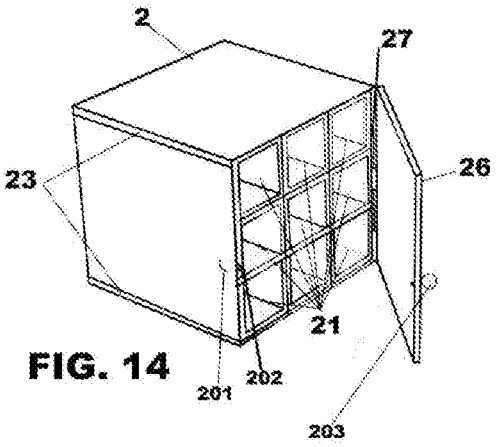
FIG. 14 is a perspective view of the alternate middle layer of the embodiment in FIG. 13, with a side door and all nine vertical tall sub-compartments rotated 90 degree clock-wise toward the side with the door to have their top openings accessible from the side upon opening of the side door.
Figure 15:
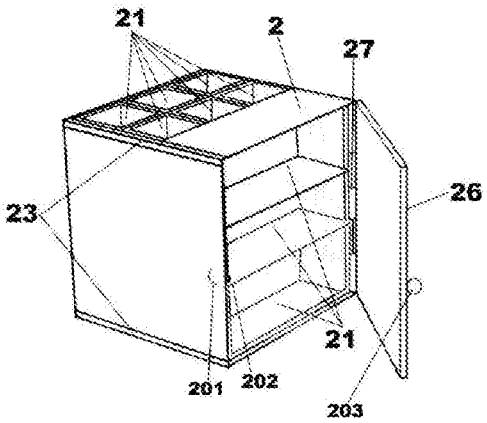
FIG. 15 is a perspective view of the alternate middle layer of the embodiment in FIG. 13, with a side door and only three vertical tall sub-compartments, that are next to the door, rotated 90 degree around the surfaces, that are perpendicular to the door, to have their top openings closed by one of the surface wall while opening up the side of the three vertical sub-compartments to have them accessible upon opening of the side door.

FIG. 13 show one example device with square shape. It has nine vertical sub-compartments at the vertical layer 2. Large number of sub-compartments leave the vertical layer with very narrow and tall vertical sub-compartments, which are very suitable to store very narrow and tall cosmetic and toiletry items like, lipstick, eye shadow, lip liner, nail polish, etc. FIGS. 14 and 15 show different arrangement of the vertical sub-compartments with a side door 26 for easy access. 203, 202, and 201 are door handle, door handle groove, and latch.

Figure 16:
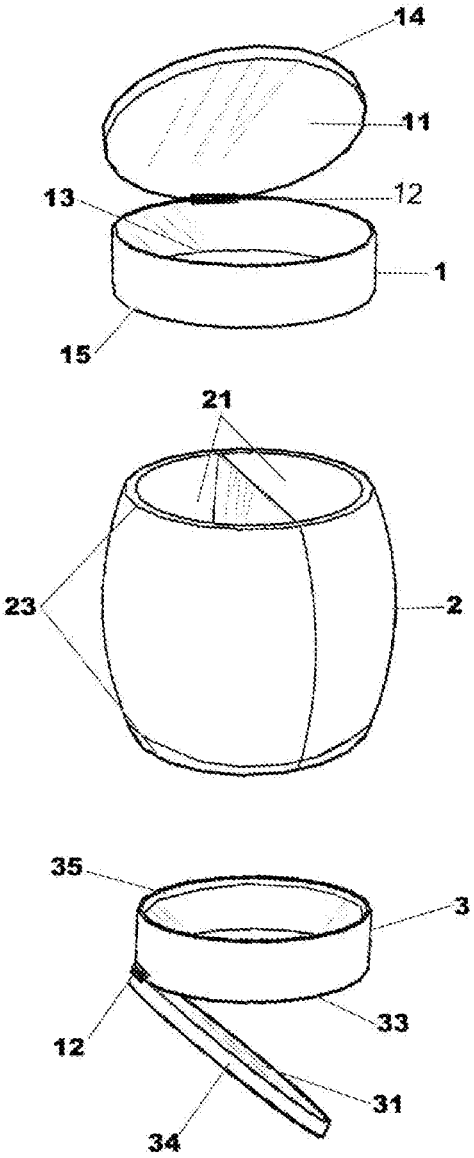
FIG. 16 is an exploded perspective view of an embodiment with a layer with gradually swollen middle and two vertical sub-compartments that is covered on the top by a horizontal compartment layer, and a horizontal compartment layer that is stuck to the bottom of the vertical layer, wherein all layers have circular perimeter.
Figure 17:
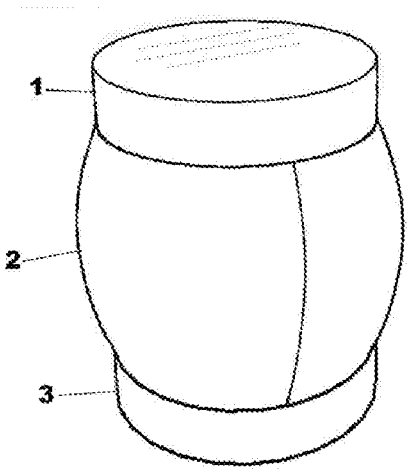
FIG. 17 is an assembled perspective view of the embodiment in FIG. 16.
Figure 18:
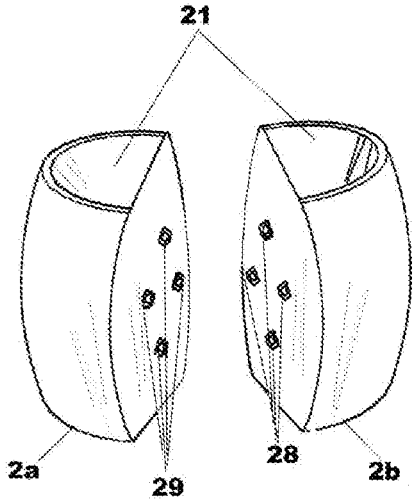
FIG. 18 is an exploded perspective view of the two vertical sub-compartments of the middle layer of the embodiment in FIGS. 16 and 17.

FIGS. 16, 17, and 18 show one example embodiment with circular shape and gradually swelled middle layer 2. Gradually swelled middle layer 2 helps to store more vertical tall cosmetic material.

Figure 19:
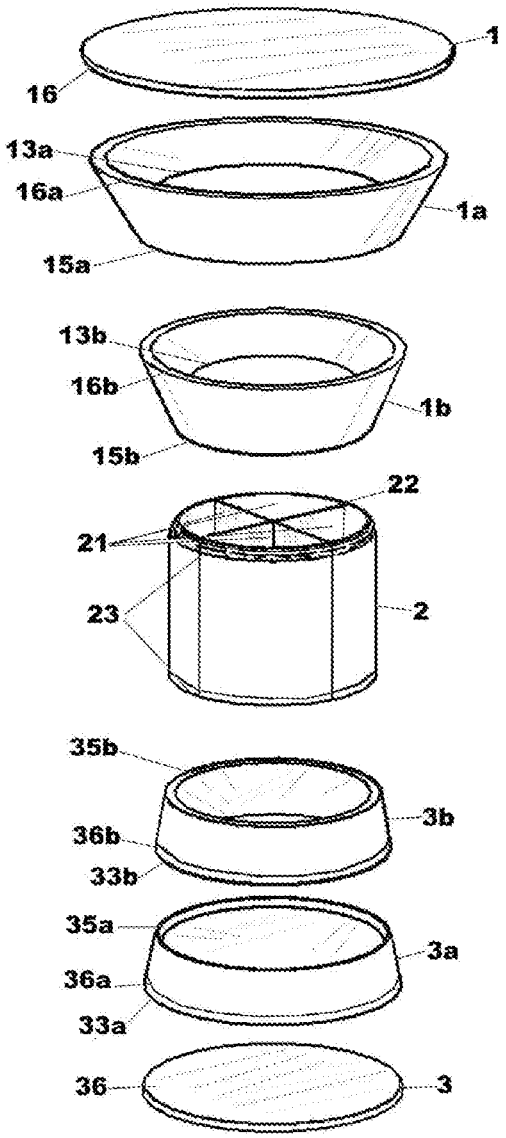
FIG. 19 is an exploded perspective view of an embodiment with a layer with four vertical sub-compartments that is covered on the top by two consecutive horizontal compartment layers stuck on top of each other with their perimeter gradually growing towards the top, and two other consecutive horizontal compartment layers that are stuck on top of each other with their perimeter gradually growing towards the bottom is stuck at the bottom of the vertical layer, wherein all layers have circular perimeter.
Figure 20:
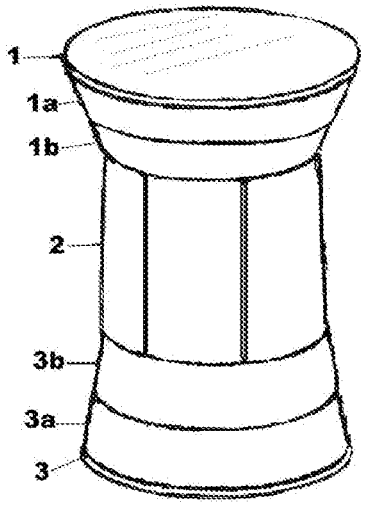
FIG. 20 is an assembled perspective view of the embodiment in FIG. 19.
Figure 21:
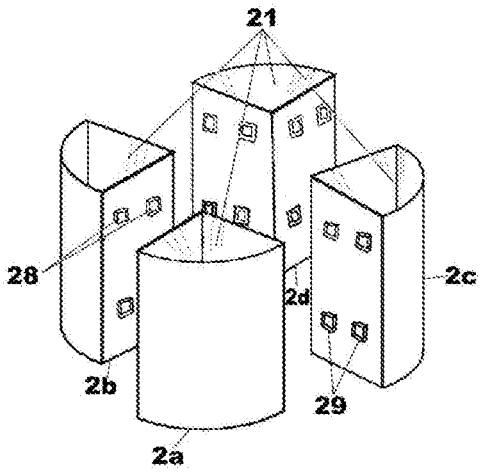
FIG. 21 is an exploded perspective view of the four vertical sub-compartments of the middle layer of the embodiment in FIGS. 19 and 20.

FIGS. 19, 20, and 21 show another example embodiment with circular perimeter shape. It has four vertical sub-compartments 2*a*, 2*b*, 2*c*, and 2*d* that are covered on the top by two consecutive horizontal compartment layers 1*a* and 1*b* stuck on top of each other with their perimeter gradually growing towards the top, and two other consecutive horizontal compartment layers 3*a* and 3*b* that are stuck on top of each other with their perimeter gradually growing towards the bottom is stuck at the bottom of the vertical layer. Top of 1*a* is covered with cover 1, and bottom of 3*a* is covered with cover 3. 1 and 3 are interchangeable. 1*a* and 3*a* are also interchangeable.

Figure 22:
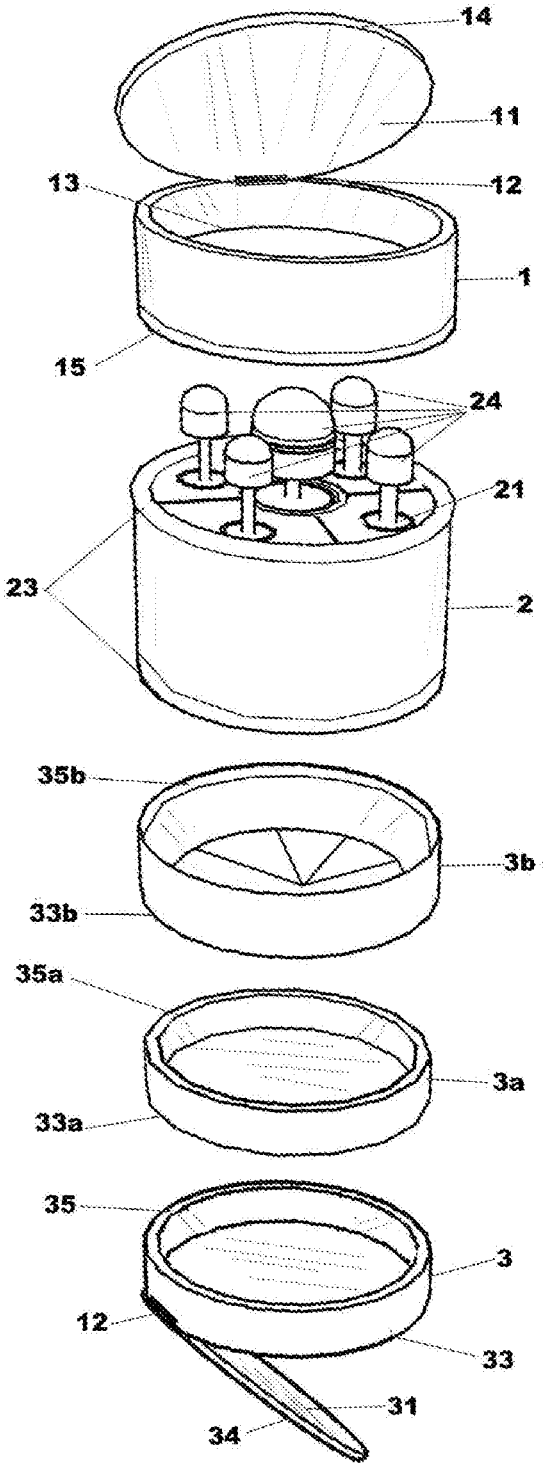
FIG. 22 is an exploded perspective view of an embodiment with a layer with five vertical sub-compartments that is covered on the top by a horizontal compartment layer, and three other consecutive horizontal compartment layers that that are stuck on top of each other are stuck at the bottom of the vertical layer, wherein all layers have square perimeter.

FIG. 22 show another example embodiment with circular perimeter shape and five vertical sub-compartments forming one vertical layer compartment unit. Top opening of the vertical sub-compartments are covered with nozzle head 24 forming receptacles of liquids in the empty cavity of that vertical sub-compartments, whereby the liquid contained in the receptacle can be sprayed using the nozzle. Perfume, deodorant, etc. liquids that are usually applied by spraying can be stored in these vertical sub-compartments.

Figure 23:
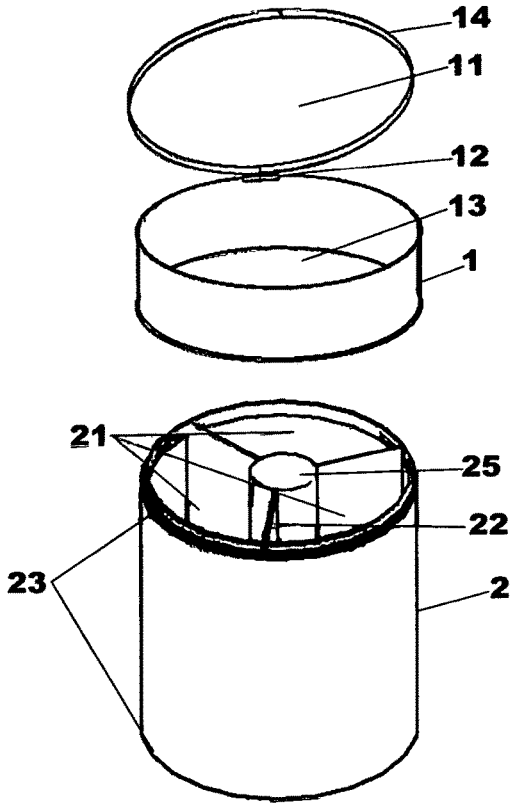
FIG. 23 is an exploded perspective view of an embodiment with a layer with four vertical sub-compartments with one circular sub-compartment at the center that is surrounded by three other sub-compartments around the perimeter, and this layer is covered on the top by a horizontal compartment layer, wherein all layers have circular perimeter.
Figure 24:
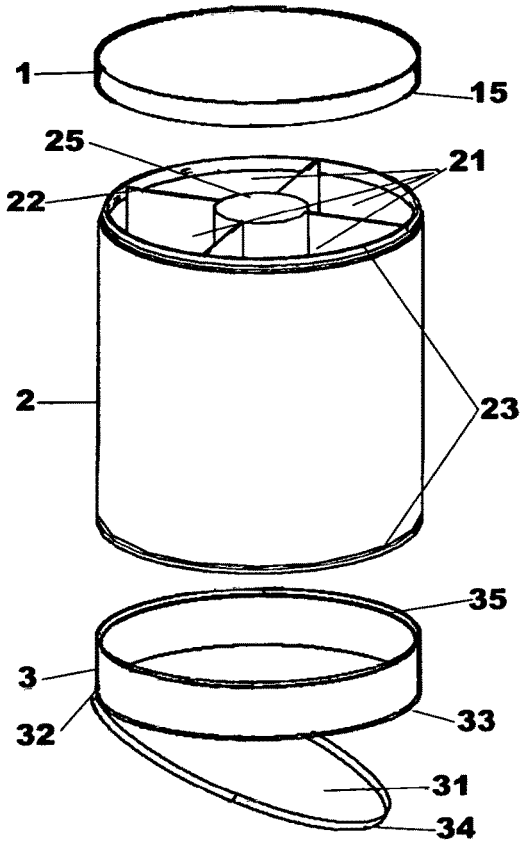
FIG. 24 is an exploded perspective view of an embodiment with a layer with five vertical sub-compartments with one circular sub-compartment at the center surrounded by four other sub-compartments around the perimeter, and this layer is covered on the top by a cover, and a horizontal compartment layer is stuck to the bottom of the vertical layer, wherein all layers have circular perimeter.

FIGS. 23 and 24 show example embodiments where a circular vertical sub-compartment at the center of vertical compartment layer helps to effectively utilize the space in the vertical layer. Efficient usage of the space helps in storing more vertical items.

The invention claimed is:

1. A device, comprising:

a plurality of compartment layers, which are configured for attachment and detachment from each other, and which are configured to contain cosmetic and personal items, wherein the plurality of compartment layers comprises:

a vertical compartment layer comprising multiple vertical sub-compartments, wherein the vertical compartment layer comprises a greater height than width, and wherein the vertical compartment layer comprises sidewalls, a bottom surface, an open top, a fastening mechanism disposed at a top peripheral edge around the open top of the vertical compartment layer, and a fastening mechanism disposed at a bottom peripheral edge around the bottom surface of the vertical compartment layer;

a plurality of horizontal compartment layers, wherein each horizontal compartment layer comprises a greater width than height, and wherein each horizontal compartment layer comprises sidewalls, a bottom surface, an open top, a fastening mechanism disposed at a top peripheral edge around the open top of the horizontal compartment layer, and a fastening mechanism disposed at a bottom peripheral edge around the bottom surface of the horizontal compartment layer;

a lidded horizontal compartment layer comprising sidewalls, a bottom surface, and a top lid that is connected to the sidewalls by a hinge, and wherein the lidded horizontal compartment layer comprises a fastening mechanism disposed at a bottom peripheral edge around the bottom surface of the lidded horizontal compartment layer;

wherein each horizontal compartment layer is configured for attachment to another horizontal compartment layer using one of (i) the fastening mechanism disposed at the bottom peripheral edge of the horizontal compartment layer and (ii) the fastening mechanism disposed at the top peripheral edge of the horizontal compartment layer, to thereby form a stack of multiple layers of horizontal compartments;

wherein each horizontal compartment layer is configured for attachment to either one of (i) the fastening mechanism disposed at the top peripheral edge of the vertical compartment layer using the fastening mechanism disposed at the bottom peripheral edge of the horizontal compartment layer and (ii) the fastening mechanism disposed at the bottom peripheral edge of the vertical compartment layer using the fastening mechanism disposed at the top peripheral edge of the horizontal compartment layer, to thereby form a stack of multiple layers of horizontal and vertical compartments; and wherein the lidded horizontal compartment layer is configured for attachment to any one of the horizontal compartment layers and the vertical compartment layer using the fastening mechanism disposed at the bottom peripheral edge of the lidded horizontal compartment layer.

2. The device of claim 1, wherein a perimeter of the horizontal compartment layers, the lidded horizontal compartment layer, and the vertical compartment layer are circular in shape.

3. The device of claim 1, wherein the top lid of the lidded horizontal compartment layer comprises a mirror disposed on an inner surface of the lid.

4. The device of claim 1, wherein the top opening of any of the vertical sub-compartments is covered with a nozzle head forming a receptacle of liquids in an empty cavity within that vertical sub-compartment, whereby the liquid contained in the receptacle can be sprayed using the nozzle.

5. A device, comprising:

a plurality of compartment layers, which are configured for attachment and detachment from each other, and which are configured to contain cosmetic and personal items, wherein the plurality of compartment layers comprises:

a plurality of horizontal compartment layers, wherein each horizontal compartment layer comprises a greater width than height, and wherein each horizontal compartment layer comprises sidewalls, a bottom surface, an open top, a fastening mechanism disposed at a top peripheral edge around the open top of the horizontal compartment layer, and a fastening mechanism disposed at a bottom peripheral edge around the bottom surface of the horizontal compartment layer; and a lidded horizontal compartment layer comprising sidewalls, a bottom surface, and a top lid that is connected to the sidewalls by a hinge, and wherein the lidded horizontal compartment layer comprises a fastening mechanism disposed at a bottom peripheral edge around the bottom surface of the lidded horizontal compartment layer;

wherein each horizontal compartment layer is configured for attachment to another horizontal compartment layer using one of (i) the fastening mechanism disposed at the bottom peripheral edge of the horizontal compartment layer and (ii) the fastening mechanism disposed at the top peripheral edge of the horizontal compartment layer, to thereby form a stack of multiple layers of horizontal compartments;

wherein the lidded horizontal compartment layer is configured for attachment to any one of the horizontal compartment layers using the fastening mechanism disposed at the bottom peripheral edge of the lidded horizontal compartment layer.

6. The device of claim 5, wherein a perimeter of the horizontal compartment layers and the lidded horizontal compartment layer are circular in shape.

7. The device of claim 5, wherein the top lid of the lidded horizontal compartment layer comprises a mirror disposed on an inner surface of the lid.

* * * * *